United States Patent [19]

Koroncai et al.

[11] Patent Number: 4,536,956

[45] Date of Patent: Aug. 27, 1985

[54] RECIPROCATINGLY DRIVABLE CUTTER FOR A DRY-SHAVING APPARATUS

[75] Inventors: Adam Koroncai; Alfred Nowak; Herbert Piber, all of Klagenfurt, Austria

[73] Assignee: U.S. Philips Corporation, New York, N.Y.

[21] Appl. No.: 414,159

[22] Filed: Sep. 2, 1982

[30] Foreign Application Priority Data

Feb. 12, 1982 [AT] Austria ..... 544/82

[51] Int. Cl.[3] ..... B26B 19/02

[52] U.S. Cl. ..... 30/43.92; 30/43.91; 30/31.2; 30/346.51

[58] Field of Search ..... 30/43.92, 43.91, 34 B, 30/34.2, 43.2, 346.51

[56] References Cited

U.S. PATENT DOCUMENTS

| | | | |
|---|---|---|---|
| 2,286,443 | 6/1942 | Scully | 30/43.92 |
| 2,833,033 | 5/1958 | Heyek | 30/43.92 X |
| 3,028,668 | 4/1962 | Dechaux | 30/346.51 X |
| 3,088,205 | 5/1963 | Ellis | 30/43.6 X |
| 4,261,101 | 4/1981 | Tietjens et al. | 30/346.51 X |

*Primary Examiner*—E. R. Kazenske
*Assistant Examiner*—Willmon Fridie, Jr.
*Attorney, Agent, or Firm*—Rolf E. Schneider

[57] ABSTRACT

A cutter reciprocatingly drivable in opposite directions and adapted to co-operate with the shear foil of a dry-shaving apparatus comprises support means and a plurality of pairs of arcuate cutter lamellae mounted on such support means. The distance between the two cutter lamellae of each pair is smaller than the distance between either cutter lamella of such pair and the adjacent cutter lamella of the adjacent pair at the location of the top of the cutter lamellae. The two cutter lamellae of each pair respectively include angular portions oriented towards each other at the location of the top of the cutter lamellae, the angular portions of the two cutter lamellae of each pair being urged against each other under pre-load. The cutter lamellae of each pair are elastically movable in both directions of reciprocation of the cutter, the leading cutter lamella of each pair, viewed in the direction of reciprocation of the cutter, acting as an elastic hair-pulling blade and the trailing cutter lamella of such pair acting as a rigid cutting blade.

7 Claims, 20 Drawing Figures

RECIPROCATINGLY DRIVABLE CUTTER FOR A DRY-SHAVING APPARATUS

The invention relates to a reciprocatingly drivable cutter for a dry-shaving apparatus, which cutter is adapted to co-operate with a shear foil and comprises a plurality of spaced adjacent arcuate cutter lamellae arranged on at least one support, the distances between one cutter lamella and the two adjacent cutter lamellae being unequal.

Such a cutter is known from Japanese Utility Model No. 49-2698. The cutter lamellae of the known cutter are arranged at different distances from each other, which distances should vary either in groups or continuously. In the central part of the cutter the distances between the cutter lamellae are smaller, because this part mainly provides the shaving action. The unequal distances between the cutter lamellae serve to provide a better shaving action, because the more closely spaced cutter lamellae pass the apertures in the shear foil at this location more frequently, and the parts with less closely spaced cutter lamellae ensure that the close contact between the shear foil and the cutter is maintained. Moreover, it is known that the distance between two cutter lamellae should not be smaller than a specific value, because then the degree of coverage of the apertures in the shear foil by the cutter lamellae becomes too high, which impairs the penetration of hairs into the apertures in the shear foil and thereby reduces the shaving action.

It is the object of the invention to further improve a cutter of the this type as regards the attainable shaving action. According to the invention this object is achieved in that the cutter lamellae are arranged in pairs, the distance between the two cutter lamellae of one pair being smaller than the distance between one cutter lamella of this pair and the adjacent cutter lamellae of an adjacent pair, at least at the location of the top. Thus, as a result of the smaller distance between the two cutter lamellae of one pair, these cutters can co-operate to cut a hair particularly short. At the same time, the greater distance between the cutters lamellae of two adjacent pairs ensures that the hairs can penetrate freely into the apertures in the shear foil in order to be severed. All in all such a cutter therefore provides a very good shaving action. Since the cutter lamellae are arranged in pairs it is also achieved that the different distances between the cutter lamellae are obtained along the entire length of the cutter, so that the entire cutter and not just a part thereof, provides a very good cutting action.

In a first embodiment of the invention the pairwise arranged cutter lamellae are flat and inherently rigid. Such cutter lamellae are known per se; for the invention it is essential that such cutter lamellae are arranged in pairs, the distance between the two cutter lamellae of a pair being smaller than their distances from the adjacent pairs of cutter lamellae. In this way it is ensured that in each of the two directions of movement of the cutter the instantaneously leading, first cutter lamella of a pair cuts a hair once, whilst under the formation of a local cutting gap a pulling action is exerted on the relevant hair so that it is pulled slightly out of its follicle. Immediately after the passage of this first cutter lamella and the closure of the cutting gap the remaining hair stubble resumes an erect position in the aperture in the shear foil, so that it is severed by the directly following second cutter lamella of this pair. This shows that the arrangement of inherently rigid cutter lamellae in pairs at decreasing, distances, which lamellae consequently both act as cutting blades, results in each hair being severed twice shortly in succession, so that the hairs are cut shorter and consequently the shaving action is improved. The greater distance between the cutter lamellae of two adjacent pairs of cutter lamellae also guarantees that the hairs can penetrate the apertures in the shear foil without being impeded.

In a second embodiment of the invention the pairwise arranged cutter lamellae are elastically movable in at least one of the two directions of the reciprocating cutter-drive movement, the leading cutter lamella of the two cutter lamellae of a pair, viewed in each of the two directions of movement, acting as an elastic hair pulling blade and the trailing cutter lamella acting as a rigid cutting blade. In this respect a hair-pulling blade is to be understood to mean an element which pulls the hair out of its follicle before it is severed by the following cutting blade, as is for example described in U.S. Pat. Nos. 3,088,205; 3,962,784; 4,258,470 and 4,261,101. Thus, the pairwise arrangement of the cutter lamellae ensures in a simple manner that in both directions of movement of the cutter each time one cutter lamella of each pair can function as a hair-pulling blade and the other cutter lamella as a cutting blade, the instantaneously leading cutter lamella pulls at the hair and thereby pulls it out of its follicle, the hair being actually severed by the following cutter lamella. As a result of this, the hairs are cut shorter and it is also ensured that between two adjacent pairs of cutter lamellae the hairs can readily penetrate into the apertures in the shear foil in order to be severed. For the construction and arrangement of the individual cutter lamellae various possibilities exist, as will be described in detail hereinafter.

It is found to be very advantageous if at least at the location of the top the two cutter lamellae of a pair include angular portions which are oriented towards each other and are formed by at least one lamella portion. This ensures in a very simple manner than each of the two cutter lamellae of a pair, depending on the direction in which the angular portions are oriented, acts as an elastic hairpulling blade in one of the two directions of movement of the cutter and as a rigid cutting blade in the other direction of movement of the cutter.

A particularly simple construction is obtained when the angular portion of each cutter lamellae is formed by a single lamella portion.

However, it is also found to be advantageous if the angular portion of each cutter lamella comprises two differently oriented lamella portions. This enables the two cutter lamellae of each pair to be arranged at a greater distance from each other at the side of the support, which may be of advantage when they are mounted on the support.

It is also advantageous if at the location of the top the angular lamella portions of the two cutter lamellae of a pair are urged against each other under pre-load. This promotes a correct co-operation of the two cutter lamellae forming a pair during a cutting process. Moreover, since the cutter lamellae slide closely against each other during cutting, a self-cleaning action is obtained for hair particles which stick to these lamellae.

However, it is also advantageous if, at the location of the top, the angular lamella portions of the two cutter lamellae of a pair are spaced from each other at their free ends. As a result of this, a cutter lamella which acts as a hair-pulling blade is more elastic and can deflect over a longer path because it is not supported directly, which promotes the hair-pulling action.

In practice it is found that a particularly satisfactory co-operation of the two cutter lamellae of a pair is obtained if at the location of the top the angular lamella portions of the two cutter lamellae of a pair each make an acute angle of the order of magnitude of 10° with a plane which extends perpendicularly to the direction of movement of the cutter.

However, it is also found to be advantageous if at the location of the top the angular lamella portions of the two cutter lamellae of a pair each extend in a plane perpendicular to the direction of movement of the cutter. This enables a larger zone portion of the cutter lamellae to be used for the hair-pulling function.

Moreover, it is found to be advantageous if adjacent each of the two cutter lamellae of a pair, viewed in a direction towards the adjacent pair, there is arranged an inherently rigid abutment against which the relevant cutter lamella is positioned at least partly when the cutter moves in a direction opposite to said viewing direction. In this way it is achieved that each of the two cutter lamellae of a pair in that direction of the reciprocating cutter-drive movement in which this cutter lamella should act as a cutting blade encounters an abutment which provides the rigidity required for a particularly exact and reliable cutting operation. The desired elasticity of the cutter lamellae can be obtained by a suitable choice of the hardness of their material and/or their thickness. However, in this respect it is found to be very advantageous if, in order to increase their elasticity, the cutter lamellae are formed with at least one cut-out at the side of the support. In this way the cutter lamellae can be dimensioned in an optimum manner as regards their cutting properties, because the desired elasticity is obtained or increased by means of the cut-out.

In practice it is also found that it is particularly favourable for the construction and the cutting process if the distance between the two cutter lamellae of a pair, at the side of the support, is selected to be of the order of magnitude of five times the thickness of one cutter lamella.

In the same respect it is also found to be advantageous if the distance, at the side of the support, between one cutter lamella of a pair and the adjacent cutter lamella of the adjacent pair is selected to be of the order of magnitude of two times the distance, at the side of the support, between the cutter lamellae of one pair.

Some embodiments of the invention will now be described in more detail, by way of example, with reference to the drawings.

Figure 1:
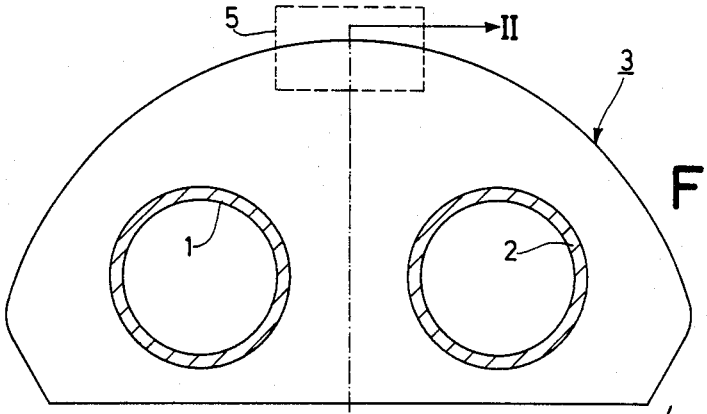
FIG. 1 shows a cutter comprising flat inherently rigid cutter lamellae arranged in pairs in a sectional view taken on the line I—I in FIG. 2, i.e. transverse to the direction of the reciprocating drive movement.
Figure 2:
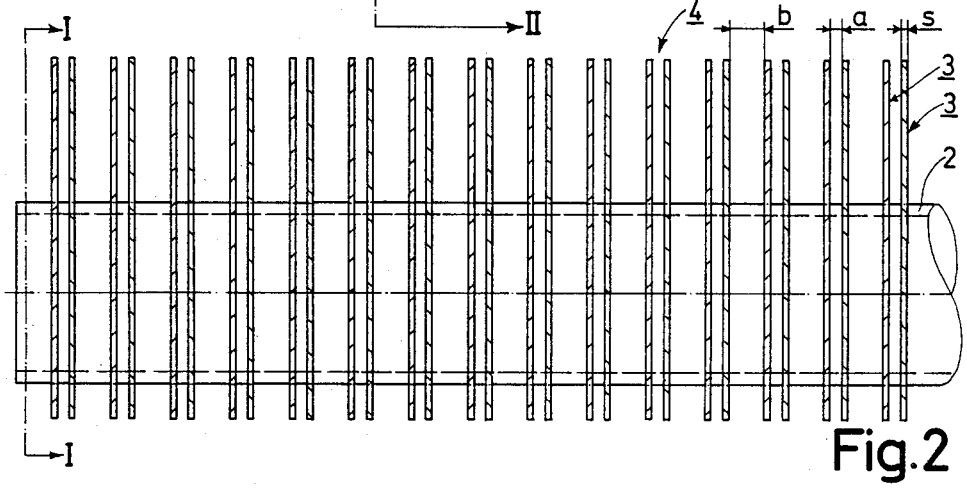
FIG. 2 represents the cutter shown in FIG. 1 in a longitudinal section taken on the line II—II in FIG. 1.

FIGS. *3a* to *3d* schematically represent the cycle of movements when a hair is cut by a cutter as shown in FIGS. 1 and 2.

Figure 4:
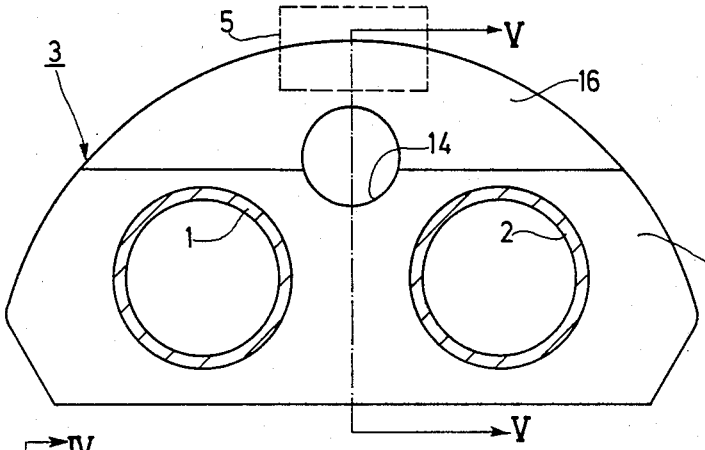
Figure 5:
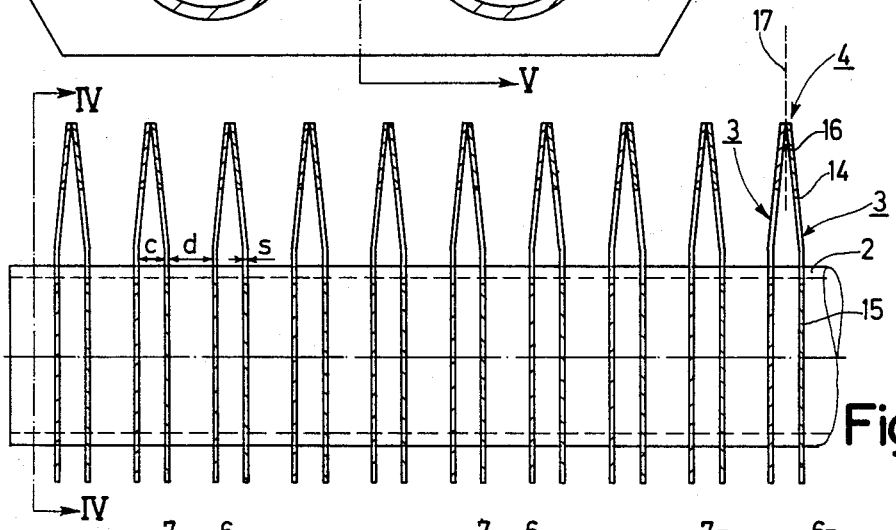

FIG. 4, in the same way as FIG. 1 and in a sectional view taken on the line IV—IV in FIG. 5, shows a cutter with elastic cutter lamellae, the two cutter lamellae of a pair, at the location of the top, comprising angular lamella portions which point towards each other.

FIG. 5 is a sectional view of the cutter shown in FIG. 4 taken on the line V—V in FIG. 4.

FIGS. *6a* to *6c* schematically represent the cycle of movements when a hair is cut by a cutter as shown in FIGS. 4 and 5.

Figure 7:
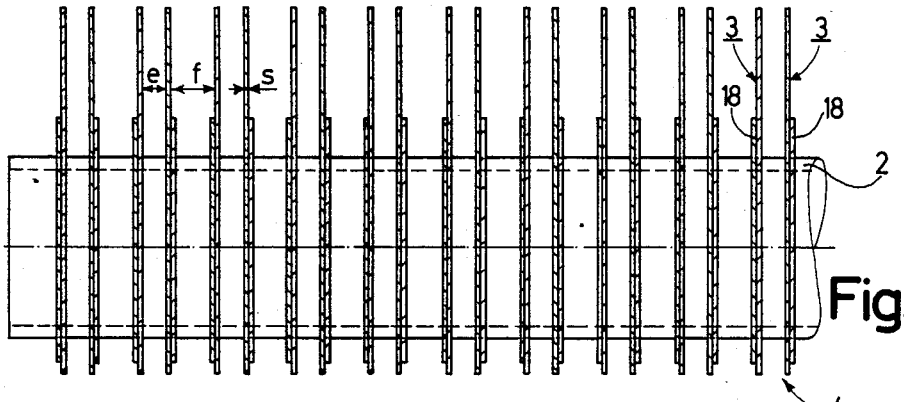

FIG. 7 is a longitudinal section of a cutter with flat elastic cutter lamellae, an inherently rigid abutment being arranged adjacent each of the two cutter lamellae of a pair, viewed in a direction towards the adjacent pair.

FIGS. *8a* and *8b* schematically represent the cycle of movements when a hair is cut by a cutter as shown in FIG. 7.

FIGS. *9a* to *9f* schematically represent various examples of cutters having cutter lamellae with different angular portions.

The cutter shown in FIGS. 1 and 2 comprises two tubular supports 1 and 2, which carry arcuate cutter lamellae 3. The cutter lamellae 3 have suitable bores to slide them on to the supports 1 and 2 and are spaced from each other, their location on the supports being for example fixed in that the tubes forming the supports are expanded from the inside after the cutter lamellae have been fitted. However, a cutter comprising cutter lamellae may also be constructed in a different manner. The cutter lamellae may for example be embedded in a plastic support.

Such a cutter is adapted to co-operate, in known manner, with an arcuate shear foil formed with a plurality of apertures, said cutter being resiliently urged against the concave side of said foil. The cutter is reciprocatingly driven by the dry-shaving apparatus, for which purpose it is provided with a coupling member, not shown, which member may for example be connected to the supports 1 and 2 by means of strips which extend between the cutter lamellae. Such a cutter should comprises as many cutter lamellae as possible, because each cutter lamella has a cutting edge in both directions of the reciprocating drive movement, the shaving action of the dry-shaving apparatus increasing as the number of cutting edges increases. However, the cutter lamellae should not be arranged too close to each other, because then they will cover the hair-entry apertures in the shear foil to such an extent that the entry of hairs into the apertures is impeded, which would reduce the shaving action. For the same reason the choice of the thickness of the cutter lamellae is of special importance. The thickness of/the cutter lamellae in known cutters of this type is for example 0.1 mm and the distance between two adjacent cutter lamellae is 1.15 mm. Such a cutter may for example co-operate with a shear foil whose thickness is 0.05 mm and whose apertures have a diameter of 0.6 mm, the portions between the apertures having a width of 0.23 mm. As can be seen, this enables hairs, whose diameter is assumed to be about 0.15 mm, to penetrate freely into the apertures of the shear foil. The dimensions of known cutters specified in the foregoing as well as those specified for the cutter in accordance with the invention should be regarded as orders of magnitude, deviations by ±50% being permissible.

In a cutter in accordance with the invention the cutter lamellae 3 are arranged in pairs; in FIG. 2 these pairs are designated 4. At the location of the top, which is schematically represented by the dashed rectangle 5, the distance a between the two cutter lamellae of a pair 4 is smaller than the distance b between the facing cutter lamellae of two adjacent pairs 4. Here the cutter lamellae 3 are flat and inherently rigid, which is known per se. Typically, the thickness s of a cutter lamella 3 may be 0.1 mm, the distance a between the two cutter lamellae 3 of a pair 4 may be twice the thickness of one cutter lamella, and the distance b between the facing lamellae 3 of two adjacent pairs 4 may be three times the distance a.

Figure 3A:
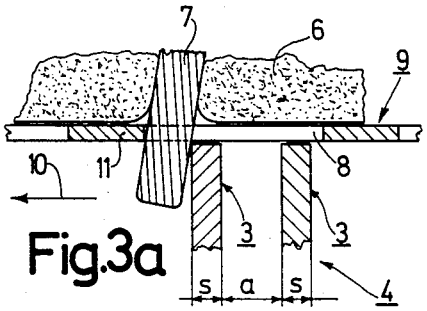

This pairwise arrangement of the cutter lamellae improves the cutting action of the cutter, because the two cutter lamellae 3 of a pair 4, which are spaced at a smaller distance from each other and which are consequently close to each other in the cycle of movements, act briefly after each other when a hair is cut, so that the hair to be cut is severed twice briefly in succession. Such a cycle of cutting movements is illustrated by means of FIGS. 3*a* to 3*d*, in which the skin is designated 6 from which a hair 7 projects, which as shown in FIG. 3*a*, extends through an aperture 8 in a shear foil 9. The instantaneous direction of movement of the cutter with its cutter lamellae 3 is assumed to be the same as the direction of the arrow 10.

Figure 3B:
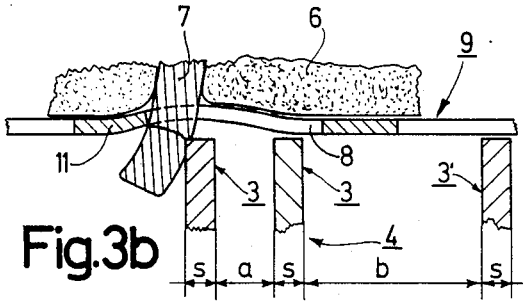
Figure 3C:
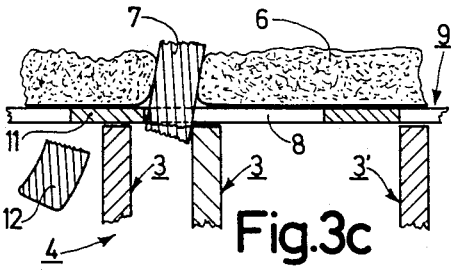
Figure 3D:
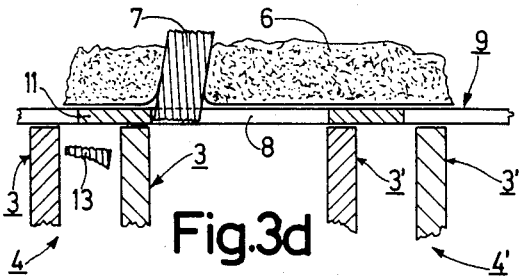

FIG. 3*a* shows how the hair 7 is clamped between the portion 11 of the shear foil 9 which bounds the aperture 8 in the direction of movement 10 and the first cutter lamella 3, viewed in the direction of movement 10 of a group 4 of two cutter lamellae 3, before the hair is actually severed. FIG. 3*b* represents the initial stage of the cutting process during which the shear foil 9 is curved towards the skin 6 and a local cutting gap is formed at the location of this aperture 8 and said first cutter lamella 3 slightly pulls at the hair 7, so that this hair is bent slightly and is pulled somewhat out of its follicle. As the cutter movement proceeds the first cutter lamella 3 severs the hair portion 12, as is indicated in FIG. 3*c*. After this cutting action the cutting gap is closed and the hair 7 resumes an upright position in the aperture 8. However, at this instant the second cutter lamella 3 of the pair 4 of cutter lamellae 3 involved in this cutting operation has already reached the hair 7 before it is withdrawn from the aperture 8 in the shear foil 9 as a result of the tension of the skin, which can also be seen in FIG. 3*c*. The second cutter lamella can now cut another portion off the same hair, as is shown in FIG. 3*d*, in which this further hair portion is designated 13. As can be seen, the two cutter lamellae 3 of a pair 4 which are arranged at the smaller distance a from each other sever each hair shortly after each other, which provides an improved shaving action. After this double cutting operation has been completed by one pair 4 of cutter lamellae 3, the next pair 4′ of cutter lamellae 3′, viewed in the direction of movement 10, reaches the aperture 8 in the shear foil 9 where the said cutting process has taken place, as can also be seen in FIG. 3*d*. The greater distance b between the adjacent cutter lamellae 3 and 3′ of the two adjacent pairs 4 and 4′ of cutter lamellae ensures that said aperture 8 in the shear foil 9 is still sufficiently free to allow the entry of another hair before the next cutter lamellae 3′ of the group 4′ reach this location, which in general also applies to the other apertures 8 in the shear foil 9.

As a result of the pairwise arrangement of the cutter lamellae with a smaller distance between the two cutter lamellae of one pair and a greater distance between consecutive pairs of cutter lamellae, it is achieved that the two cutter lamellae of one pair cut the hairs shorter and that the entry of the hairs into the apertures in the shear foil is not impeded, which applies to the entire length of the cutter, so that by means of such a cutter a very goods having action is obtained.

In the embodiment shown in FIGS. 4 and 5 the cutter lamellae 3 are again arranged in pairs 4. However, in this embodiment cutter lamellae are used which are elastically movable in both directions of the reciprocating cutter-drive movement, which can be achieved by the choice of their thickness and/or the hardness of the material used. In order to increase this elasticity even further or to obtain a greater independence of the dimensioning of the cutter lamellae, the individual cutter lamellae are moreover formed with a cut-out 14 at the side of the support. As a result of the elasticity of the cutter lamellae the leading cutter lamella of the two cutter lamellae 3 of a pair 4, viewed in each of the two directions of movement, acts as a hair-pulling blade and the trailing cutter lamella acts as a cutting blade, which will be described in more detail hereinafter.

Moreover, the cutter lamellae 3 are constructed so that near the two supports 1 and 2 they comprise parallel lamella portions 15 which extend perpendicularly to the direction of movement of the cutter and which serve for mounting the cutter lamellae onto the two supports, which portions, towards the top 5, adjoin lamella portions 16 which are inclined relative to the portions 15. The cutter lamellae 3 are mounted onto the supports 1 and 2 in such a way that the angular portions 16 of the two cutter lamellae 3 of a pair 4 point towards each other at the location of the top 5. For a particularly satisfactory performance these angular portions are constructed so that the portions 16 form an acute angle of the order of magnitude of 10° with a plane 17 which is perpendicular to the direction of movement of the cutter, as can be seen in FIG. 5. Furthermore, the cutter lamellae 3 are arranged on the supports 1 and 2 in such a way that the angular lamella portions 16 of the two cutter lamellae 3 which form a pair 4 and are disposed at the location of the top 5 are urged against each other under a pre-load. The distance c, at the side of the support, between the two cutter lamellae 3 of a pair 4 is smaller than the distance d, at the side of the support, between the facing cutter lamellae 3 of two adjacent pairs 4. However, it is found to be very advantageous if the distance c is of the order of magnitude of five times the thickness s of a cutter lamella and the distance d is of the order of magnitude of two times the distance c, which thickness s of a cutter lamella may be 0.08 mm.

During the manufacture of such a cutter the cutter lamellae which are punched out of a flat material in arcuate form are consecutively formed with the angular lamella portion 16 and are subsequently slid in pairs onto the tubes forming the supports 1 and 2 with the angular portions pointing towards each other, after which they are fixed onto said tube at the correct distances c and d. Subsequently, the peripheral surfaces of all cutter lamellae are subjected to a common grinding operation, which ensures a correct co-operation of the shear foil with the peripheral portions of the cutter lamellae.

Figures 6A, 6B, 6C:
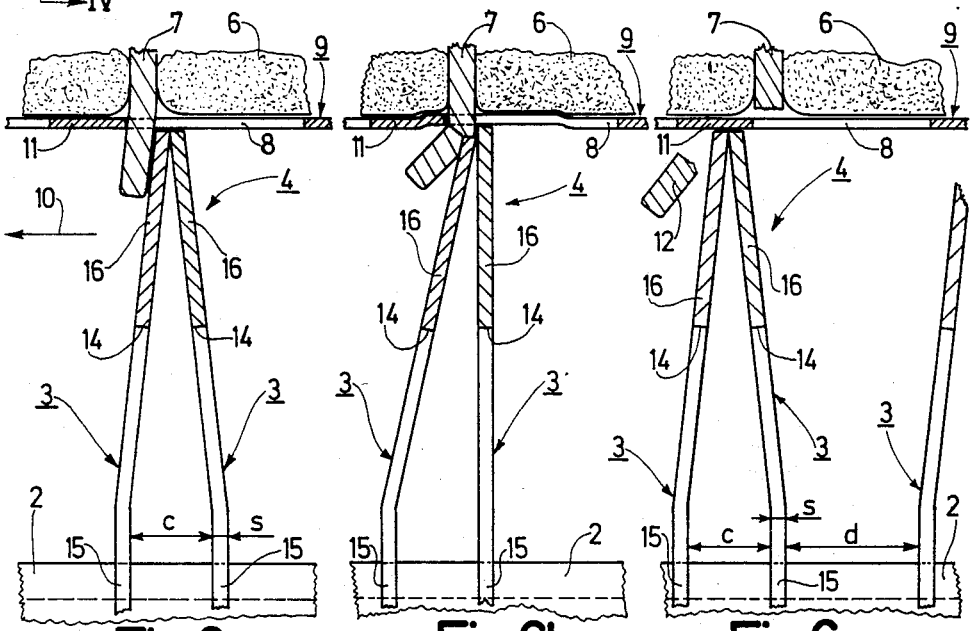

The operation of such a cutter will now be explained with reference to FIGS. 6*a* to 6*c*, assuming that the instantaneous direction of movement of the cutter again corresponds to the direction of the arrow 10. FIG. 6*a* shows the situation before a cutting process, a hair 7 projecting through an aperture 8 in the shear foil 9 and being already clamped between the portion 11 of the shear foil 9 which bounds this aperture 8 in the direction of movement 10, and the first cutter lamella 3, viewed in the direction of movement 10 of a group 4 of two cutter lamellae 3. As the cutter movement continues, the free end of the portion 16 of said first cutter lamella 3 penetrates the hair 7 and pulls at this hair, the portion 16 of this cutter lamella being bent towards the second cutter lamella 3 of this pair as a result of its elasticity. During this bending of the portion 16 of the first cutter lamella 3, its upper portion slides along the upper portion of the second cutter lamella 3 of the pair 4, so that this cutter lamella is also bent in the same direction as a result of its elasticity, causing the angular portion 16 to assume an upright position and to be substantially straightened. This results in a local deformation of the shear foil 9 towards the skin 6. The contact pressure between the shear foil 9 and said second cutter lamella 3 then increases, so that the last-mentioned lamella looses its elasticity and in fact functions as a rigid cutting blade. The said increased pressure between the shear foil 9 and the second cutter lamella 3 also ensures that in the present case practically no cutting gap is formed. This situation is represented by FIG. 6*b*. As the cutter movement proceeds the second erect cutter lamella 3 now severs the end portion 12 from the hair 7, so that the force acting on the two cutter lamellae 3 of this pair 4 ceases, and the portions 16 of the two cutter lamellae 3, under the influence of their elasticity, resume their initial positions, the local deformation of the shear foil 9 being also eliminated, as is shown in FIG. 6*c*.

By means of such a cutting process a hair is cut off shorter than is normally possible. This depends on three factors. The principal factor is that the first cutter lamella in the direction of movement of the cutter pulls at the hair 7 before the actual cutting process, so that it is slightly pulled out of its follicle and is further pulled into the aperture 8 in the shear foil, as a result of which a longer portion of the hair can be cut off. Moreover, as a result of the local deformation of the shear foil 9 at the location of the aperture 8, where the foil is urged towards the skin, an additional part of the hair 7 projects into the aperture 8 in the shear foil and is consequently also cut. Finally, as a result of the increased contact pressure between the shear foil 9 and the second cutter lamella 3 which severs the hair hardly any cutting gap is formed, so that the hair is cut off even shorter. In this way such a cutter provides a very good shaving action.

This shows that the leading cutter lamella 3, viewed in the direction of movement of the cutter, of a pair 4 of cutter lamellae 3 acts as an elastic hair-pulling blade and the next cutter lamella 3 in this direction of movement of the cutter, whose rigidity increases while the hair-pulling blade is active, acts as a rigid cutting blade. In this way it is ensured that the cutter is equally effective in both directions of movement. The construction of the cutter is very simple, because then functions are performed by two cutter lamellae only and it is not necessary to provide a separate hair-pulling blade for each cutting blade in each of the two directions of movement, which is known per se.

Since in the present embodiment the angular lamella portions 16 of the two cutter lamellae 3 forming a pair 4 are urged against each other under pre-load, this provides a very satisfactory co-operation of the two cutter lamellae which alternately act as a hair-pulling blade and as a cutting blade. At the top, of the two cutter lamellae this pre-load also provides a very good cleaning effect for hair particles which may stick to these lamellae, because the cutter lamella which acts as a hair-pulling blade slides along the cutter lamella which acts as a cutting blade with some force.

It is obvious that the two cutter lamellae 3 of a pair 4 are positioned exactly against each other with their angular portions 16 at the top only. From the top downwards the distance between these two cutter lamellae increases until the end of the angular portion is reached near the side of the support, after which the two cutter lamellae extend substantially parallel at a distance c to each other with their portions 15. As a result of this, the hair-pulling action of the cutter lamellae 3 is in principle limited to the upper part 5 of the portions 16 of the cutter lamellae, but this is not a real disadvantage. The part which mainly provides the shaving action is the upper part when the dry-shaving apparatus is used in the customary manner, but here the desired performance is guaranteed.

A further advantageous effect is obtained because the distance between the two cutter lamellae 3 of a pair 4 is smaller than the distance between the facing cutter lamellae 3 of two adjacent pairs 4. As the distance between the two cutter lamellae 3 of a pair 4 increases in the circumferential direction to both sides of the top area, their elasticity decreases so that on both sides of the top area two cutter lamellae will act as rigid cutting blades and consequently the situation which has been described for the embodiment shown in FIGS. 1 and 2 is obtained during cutting of the hairs. This means that in both areas adjoining the top area the cutter lamellae sever the hairs which enter the apertures in the shear foil at these locations two times briefly after each other, so that also at these locations the hairs are cut shorter than normally. The greater distance between the facing cutter lamellae of two adjacent pairs of cutter lamellae again ensures that the entry of the hairs into the apertures in the shear foil is not impeded. In this way such a cutter provides a substantial overall improvement of the shaving action.

The embodiment shown in FIG. 7 again comprises elastic cutter lamellae 3, but in this case these lamellae are flat. Two of such cutter lamellae 3 again form a pair 4, the distance e between the two cutter lamellae 3 of a pair 4 being smaller than the distance f, between the facing cutter lamellae 3 of two adjacent pairs 4. In an example which is typical of the dimensions, the thickness s of a cutter lamella may be 0.08 mm, the distance e may be substantially equal to five times the thickness s and the distance f may be substantially equal to twice the distance e. In the present embodiment an inherently rigid abutment 18 is arranged adjacent each of the two cutter lamellae 3 of the pair 4, viewed towards the adjacent pair 4, against which abutment the relevant cutter lamellae 3 is positioned at at least partly during the movement of the cutter in a direction opposite to said viewing direction. In this way each of the two cutter lamellae 3 of a pair 4 is elastically movable in a direction towards the adjacent cutter lamella of the same pair, whilst each of the two cutter lamellae 3 of a pair 4 is rigid in a direction towards the adjacent pair 4, because the adjacent abutment 18 counteracts an elastic movement in this direction. As a result of this, the two cutter lamellae 3 of a group 4, alternately act as a hair-pulling blade and as a cutting blade depending on the instantaneous direction of movement of the cutter. In the present embodiment the abutments 18 are formed by strip-shaped portions which in the same way as the cutter lamellae are formed with bores, so that they can be slid onto the cutter supports formed by the tubes, of which supports only the support 2 is visible in FIG. 7. After the cutter lamellae 3 and the abutments 18 have been positioned correctly relative to each other they are secured to the supports. The rigidity which results when a cutter lamella is positioned against its adjacent abutment is defined by suitably dimensioning the abutment, which may be achieved by the choice of the material and the shape. Obviously, such abutments may be constructed in a different manner, for example as spacers arranged between the cutter lamellae.

Figure 8A:
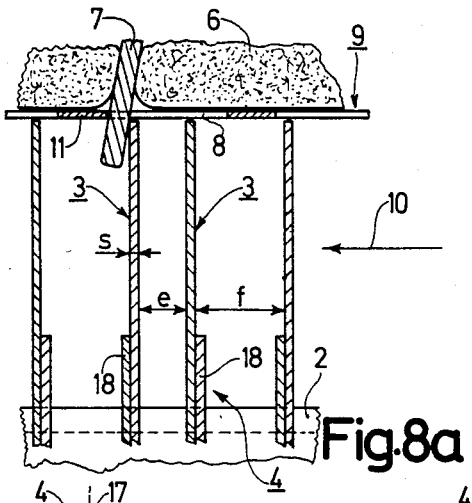
Figure 8B:
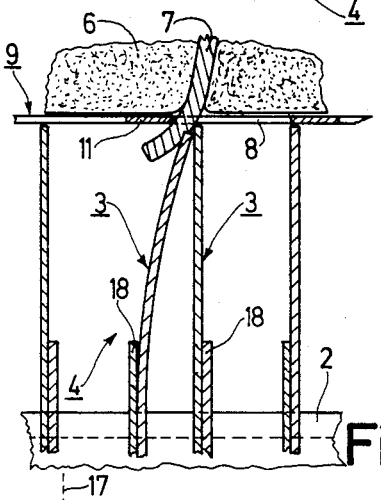

The operation of such a cutter will be described with reference to FIGS. 8*a* and 8*b*. FIG. 8*a* again represents a hair 7 which has entered an aperture 8 in a shear foil, which hair is already clamped between the portion 11 of the shear foil 9 which bounds said aperture 8 in the direction of movement 10 of the cutter and the first leading cutter lamella 3, viewed in this direction of movement, of a group 4 of two cutter lamellae. As the cutter movement proceeds, the free end of said first cutter lamella 3, which is located at the top, penetrates into the hair 7, after which this cutter lamella 3 is bent towards the next, second cutter lamella 3 and butts against this last-mentioned lamella, at which instant this second cutter lamella 3 has also reached the hair 7, as is shown in FIG. 8*b*. During this bending of the leading, first cutter lamella 3 this lamella pulls at the hair 7, so that the hair is pulled somewhat out of its follicle and is urged further into the aperture 8 in the shear foil. In this way the leading cutter lamella 3 in the instantaneous direction of movement of the cutter again acts as a hair-pulling blade. As the cutter movement proceeds, the second cutter lamella 3 initiates the cutting operation, because viewed in this direction of movement, as a result of its contact with the adjacent abutment 18, it is essentially rigid and thus acts as a cutting blade. In this way longer parts of the hair are severed than normally attainable by the action of a hair-pulling blade.

In this present embodiment a cutter lamella which acts as a hair-pulling blade is deflected over a path-length which is defined by the distance e between the two cutter lamellae 3 of a pair 4, because the cutter lamella bends as far as the following cutter lamella which forms the cutting blade. This results in a longer hair-pulling range in which the hair-pulling blade pulls at the hair and thereby pulls it out of the hair follicle, so that a closer shave is obtained. In the same way as in the embodiment shown in FIGS. 4 and 5 this action of the two cutter lamellae 3 forming a pair 4, i.e. as a hair-pulling blade and as a cutting blade, is mainly obtained at the top of the cutter lamellae, because the elasticity of the cutter lamellae is a maximum at this location. Since in the present embodiment the two cutter lamellae 3 of a pair 4 are not in contact with each other in their initial position, the cutter lamella which instantaneously acts as a hair-pulling blade can also deflect to some extent at the peripheral locations which are more remote from the top and thereby act as a hair-pulling blade. At the peripheral locations nearer the sides the cutter lamellae 3 forming a pair again function as two cutting blades which act shortly after each other as a result of their increasing rigidity and their small distance from each other, so that also at these locations a closer shave is obtained without the entry of hairs into the apertures in the shear foil being impeded, because the distance between the facing cutter lamellae of two adjacent pairs of cutter lamellae is again greater than the distance between the two cutter lamellae of one pair.

Further embodiments of cutters with elastic cutter lamellae will be described with reference to FIGS. 9*a* to 9*f*. In these embodiments it is assumed that the cutter lamellae are arranged on the support 1, which is formed by a single block, with their portions 15 at equal distances g from each other at the side of the support. However, it is obvious that all these embodiments may have different distances between the cutter lamellae at the side of the support. Similarly, arbitrary support constructions may be used. Moreover, abutments corresponding to those in the embodiment shown in FIG. 7 may be arranged adjacent the cutter lamellae. The present embodiments are therefore embodiments which are in principle possible as regards the construction and arrangement of the cutter lamellae.

Figure 9A:
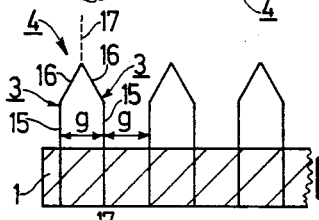

In FIG. 9*a* the two cutter lamellae 3 of a pair 4 are formed with angular portions which adjoin the lamella portions 15 at the side of the support and which point towards each other, an angular portion being formed by a single lamella portion 16 in the same way as in the embodiment shown in FIGS. 4 and 5. However, in the present case the angular lamella portions 16 have a greater inclination relative to a plane 17 which is perpendicular to the direction of movement of the cutter, so that the distances at, the side of the support, between the cutter lamellae of a pair can be increased, which facilitates mounting of such a cutter. As can be seen in FIG. 9*a*, the situation is now such that both the distance, at the side of the support, between the two cutter lamellae 3 of a pair 4, and the distance between the facing cutter lamellae 3 of two adjacent pairs 4 are equal. However, the angular portions 16 ensure that, viewed from the support 1 towards the top of the cutter lamellae 3, the distance between the two cutter lamellae 3 of a pair is smaller than the distance between the facing cutter lamellae 3 of two adjacent pairs 4. Moreover, the angular lamella portions 16 of the two cutter lamellae 3 forming a pair 4 which are situated directly near the upper part are urged towards each other under a pre-load. Such a cutter again operates in the same way as described for the embodiment shown in FIGS. 4 and 5.

Figure 9B:
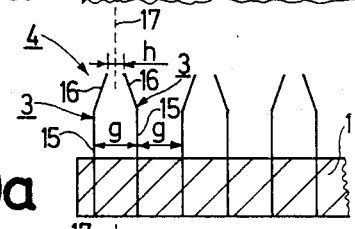

The embodiment shown in FIG. 9*b* has a construction similar to that of FIG. 9*a*, but at the top the angular lamella portions 16 of the two cutter lamellae 3 of a pair 4 are spaced at a distance h from each other at their free ends, so that in the same way as in the embodiment shown in FIG. 7 the path over which the cutter lamellae are elastically movable and act as hair-pulling blades is larger, so that the hair-pulling action is also improved.

Figure 9C:
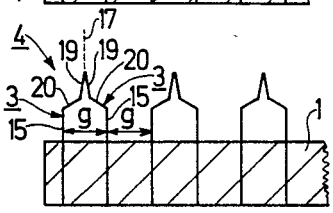

The embodiment shown in FIG. 9*c* comprises two differently inclined angular portions 19 and 20, the upper angular lamella portions 19 of the two cutter lamellae 3 of a pair 4 each making an acute angle of the order of magnitude of 10° with a plane 17 perpendicular to the direction of movement of the cutter and again being urged against each other under pre-load. As a result of the different angles, the portions 20 have a greater inclination relative to the plane 17. In this way it is possible to arrange the two cutter lamellae 3 of a pair 4 so that their portions 15 at the side of the support are situated at a greater distance from each other, whilst near the top of the cutter lamellae the portions 19 having a more acute angle relative to the plane 17 can be maintained, which is found to be favourable for a satisfactory cooperation of the two cutter lamellae of a pair 4, of which one lamella always acts as a hair-pulling blade and the other as a cutting blade.

Figure 9D:
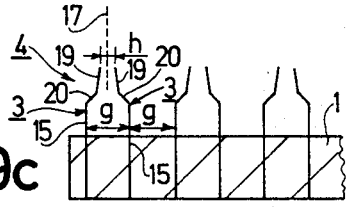

FIG. 9*d* d shows an arrangement of the cutter lamellae 3 similar to that shown in FIG. 9*c*, the angular lamella portions 19 near the top of the two cutter lamellae 3 of a pair 4 being spaced from each other with their free ends, in the same way as in the embodiment shown in FIG. 9*b*.

Figure 9E:
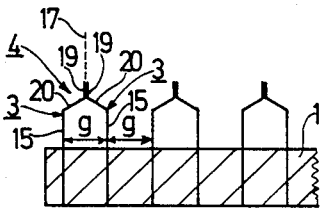
Figure 9F:
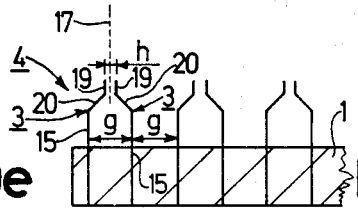

In the embodiment shown in FIG. 9*e*, in the same way as in the embodiment shown in FIG. 9*c*, the cutter lamellae again comprise two differently oriented angular lamella portions 19 and 20, but here the upper lamella portions 19 of the two cutter lamellae 3 of a pair 4 are each situated in a plane 17 which is perpendicular to the direction of movement of the cutter. Again the upper lamella portions 19 are urged against each other under pre-load. As a result of this, the two parallel lamella portions 19 of the two cutter lamellae 3 of a pair 4 butt against each other. When a cutter lamella 3 of the relevant pair 4 acts as a hair-pulling blade its portion 19 slides along the portion 19 of the other cutter lamella 3 which functions as a cutting blade. With this construction of the lamella portions 19 the hair-pulling range then extends over the entire peripheral area of the portions 19, the deflection path of the cutter lamellae which act as hair-pulling blades then being reduced. This deflection path for the cutter lamellae which act as hair-pulling blades may be increased if the angular portions 19 of the two cutter lamellae 3 of a pair 4 extend at a distance h from each other, as is shown in the embodiment of FIG. 9*f*.

What is claimed is:

1. A cutter reciprocatingly drivable in opposite directions and adapted to co-operate with the shear foil of a dry-shaving apparatus, which comprises support means; and a plurality of pairs of arcuate cutter lamellae mounted on said support means, the distance between the two cutter lamellae of each pair being smaller than the distance between either cutter lamella of such pair and the adjacent cutter lamella of the adjacent pair at the location of the top of the cutter lamellae; the two cutter lamellae of each pair respectively including angular portions oriented towards each other at the location of the top of the cutter lamellae, the angular portions of the two cutter lamellae of each pair being urged against each other under pre-load; and the cutter lamellae of each pair being elastically movable in both directions of reciprocation of the cutter, the leading cutter lamella of each pair, viewed in the direction of reciprocation of the cutter, acting as an elastic hair-pulling blade and the trailing cutter lamella of such pair acting as a rigid cutting blade.

2. A cutter according to claim 1, in which each cutter lamella includes a single angular portion.

3. A cutter according to claim 1, in which each cutter lamella includes two differently oriented angular portions.

4. A cutter according to claim 1, in which, at the location of the top of the cutter lamellae, the angular portions of the two cutter lamellae of each pair form an acute angle on the order of 10° with a plane extending perpendicularly to the direction of reciprocation of the cutter.

5. A cutter according to claim 1, in which, at the location of the top of the cutter lamellae, the angular portions of the two cutter lamellae of each pair each extend in a plane perpendicular to the direction of reciprocation of the cutter.

6. A cutter according to claim 1, in which, adjacent each cutter lamella of a pair, viewed in a direction towards the adjacent pair, there is arranged an inherently rigid abutment, the respective cutter lamella being positioned at least partly against such abutment when the cutter is reciprocated in a direction opposite to said viewing direction.

7. A cutter according to claim 1, in which each cutter lamella of a pair is formed with at least one cut-out in order to increase its elasticity.

* * * * *